US008376480B2

(12) United States Patent
Brunnmayr

(10) Patent No.: US 8,376,480 B2
(45) Date of Patent: Feb. 19, 2013

(54) ACTUATING MECHANISM FOR MOVING AN UPWARDLY MOVABLE FLAP OF A PIECE OF FURNITURE

(75) Inventor: Harald Brunnmayr, Hörbranz (AT)

(73) Assignee: Julius Blum GmbH, Hochst (AT)

( * ) Notice: Subject to any disclaimer, the term of this patent is extended or adjusted under 35 U.S.C. 154(b) by 136 days.

(21) Appl. No.: 12/778,280

(22) Filed: May 12, 2010

(65) Prior Publication Data

US 2010/0229672 A1 Sep. 16, 2010

Related U.S. Application Data

(63) Continuation of application No. PCT/AT2008/000388, filed on Oct. 24, 2008.

(30) Foreign Application Priority Data

Dec. 19, 2007 (AT) ..... A 2064/2007

(51) Int. Cl.
*A47B 88/00* (2006.01)
*A47B 95/02* (2006.01)

(52) U.S. Cl. ..... 312/323; 312/319.2

(58) Field of Classification Search ..... 312/323–329, 312/319.5, 319.7; 16/286, 366, 289; 49/246, 49/247, 248, 253, 261
See application file for complete search history.

(56) References Cited

U.S. PATENT DOCUMENTS 1,145,264 A * 7/1915 Pflug ..... 312/266
1,496,965 A * 6/1924 Aldeen ..... 217/60 G
2,076,878 A * 4/1937 Brunst ..... 49/205
2,355,542 A * 8/1944 Loftin ..... 16/371
2,463,250 A * 3/1949 Curtiss, Jr. ..... 49/317
2,543,485 A * 2/1951 Briggs ..... 312/27
2,797,917 A * 7/1957 Lickteig, Jr. et al. ..... 49/249
2,869,954 A * 1/1959 Kesling ..... 312/275
2,912,237 A * 11/1959 Snyder ..... 49/199
3,059,985 A * 10/1962 Peck ..... 312/279
3,081,138 A * 3/1963 Stebbins ..... 312/319.3
3,345,777 A * 10/1967 Anderberg et al. ..... 49/248
3,425,766 A * 2/1969 Crisera ..... 312/294
4,230,295 A * 10/1980 Eppler ..... 244/213
4,703,540 A * 11/1987 Davis ..... 16/337

(Continued)

FOREIGN PATENT DOCUMENTS

CH 359873 3/1962
CN 101061287 10/2007

(Continued)

OTHER PUBLICATIONS

Machine translation of DE 3222407.*

(Continued)

*Primary Examiner* — Janet M Wilkens
*Assistant Examiner* — Kimberley S Wright
(74) *Attorney, Agent, or Firm* — Wenderoth, Lind & Ponack, L.L.P.

(57) ABSTRACT

An actuating mechanism for moving a highly movable flap of a piece of furniture includes a main body intended for attachment to a furniture body. An actuating arm for moving the flap has one end mounted on a bearing axis of the main body and the other end mounted on a bearing axis of a fitting part intended for attachment to the flap. An additional control arm for moving the flap is also provided. During the movement of the control arm, the effective lever arm length of the control arm can be varied, and the effective lever arm length of the control arm is shortened when opening the actuating arm.

12 Claims, 7 Drawing Sheets

U.S. PATENT DOCUMENTS

| | | | | |
|---|---|---|---|---|
| 4,783,131 | A * | 11/1988 | Grass | 312/276 |
| 4,823,508 | A * | 4/1989 | Allen | 49/252 |
| 5,050,345 | A * | 9/1991 | Nakanishi | 49/279 |
| 5,062,182 | A * | 11/1991 | Griffiths et al. | 16/368 |
| 5,103,532 | A * | 4/1992 | Youngdale et al. | 16/288 |
| 5,210,908 | A * | 5/1993 | Bucher | 16/368 |
| 5,239,776 | A * | 8/1993 | Lhotak | 49/199 |
| 5,440,837 | A * | 8/1995 | Piltingsrud | 49/139 |
| 5,971,514 | A * | 10/1999 | Hayakawa | 312/319.2 |
| 6,193,300 | B1 * | 2/2001 | Nakatomi et al. | 296/107.08 |
| 6,227,612 | B1 * | 5/2001 | Stolle et al. | 296/208 |
| 6,296,337 | B1 * | 10/2001 | Kawanabe | 312/319.2 |
| 6,568,035 | B2 * | 5/2003 | Zetti | 16/370 |
| 6,574,835 | B2 * | 6/2003 | Melhuish | 16/282 |
| 6,880,189 | B2 * | 4/2005 | Welling et al. | 5/624 |
| 6,928,697 | B2 * | 8/2005 | Brain et al. | 16/193 |
| 7,100,241 | B2 * | 9/2006 | Zetti | 16/304 |
| 7,168,477 | B2 * | 1/2007 | Salice | 160/213 |
| 7,171,708 | B2 * | 2/2007 | Osborne et al. | 5/618 |
| 7,178,202 | B2 * | 2/2007 | Hirtsiefer et al. | 16/366 |
| 7,240,974 | B2 * | 7/2007 | Hirtsiefer | 312/109 |
| 7,707,687 | B2 * | 5/2010 | Giovannetti | 16/289 |
| 7,797,796 | B2 * | 9/2010 | Migli | 16/366 |
| 7,806,458 | B2 * | 10/2010 | Meinert | 296/107.08 |
| 7,810,213 | B2 * | 10/2010 | Brustle | 16/286 |
| 7,887,147 | B2 * | 2/2011 | Karg | 312/319.2 |
| 7,966,699 | B2 * | 6/2011 | Dubach et al. | 16/386 |
| 8,011,741 | B2 * | 9/2011 | Mattle | 312/319.5 |
| 8,066,341 | B2 * | 11/2011 | Brustle | 312/319.5 |
| 8,082,629 | B2 * | 12/2011 | Migli | 16/366 |
| 2001/0025398 | A1 * | 10/2001 | Zetti | 16/370 |
| 2001/0039762 | A1 * | 11/2001 | Giovannetti | 49/246 |
| 2005/0061585 | A1 * | 3/2005 | Yingst | 186/38 |
| 2005/0264144 | A1 * | 12/2005 | Verbeek et al. | 312/323 |
| 2006/0284530 | A1 * | 12/2006 | Hollenstein | 312/327 |
| 2007/0124893 | A1 * | 6/2007 | Brustle | 16/296 |
| 2007/0180654 | A1 * | 8/2007 | Gasser | 16/242 |
| 2007/0209157 | A1 * | 9/2007 | Kung | 16/240 |
| 2007/0257538 | A1 * | 11/2007 | Brunnmayr | 297/423.12 |
| 2008/0121490 | A1 * | 5/2008 | Dubach et al. | 192/17 D |
| 2008/0196203 | A1 * | 8/2008 | Giovannetti | 16/239 |
| 2008/0209682 | A1 * | 9/2008 | Dubach et al. | 16/319 |
| 2008/0238276 | A1 * | 10/2008 | Migli | 312/326 |
| 2011/0162145 | A1 * | 7/2011 | Osborne et al. | 5/618 |

FOREIGN PATENT DOCUMENTS

| | | | |
|---|---|---|---|
| DE | 3222407 | A1 * | 3/1983 |
| EP | 0 952 290 | | 10/1999 |
| EP | 1 785 565 | | 5/2007 |
| WO | WO2006099645 | * | 9/2006 |
| WO | WO2006113961 | * | 11/2006 |

OTHER PUBLICATIONS

Machine transalation of WO 2006/113961.*
Machine transalation of WO 2006/099645.*
International Search Report issued Jan. 21, 2009 in International (PCT) Application No. PCT/AT2008/000388.
Austrian Search Report issued Aug. 19, 2009 in A 2064/2007.

* cited by examiner

ACTUATING MECHANISM FOR MOVING AN UPWARDLY MOVABLE FLAP OF A PIECE OF FURNITURE

This application is a continuation application of International application PCT/AT2008/000388, filed Oct. 24, 2008, the entire disclosure of which is incorporated herein by reference.

BACKGROUND OF THE INVENTION

The present invention relates to an actuating mechanism for moving an upwardly movable flap of an article of furniture, comprising a main body to be fixed to a furniture body. An actuating arm for moving the flap is mounted, on the one hand, at a mounting axis of the main body and, on the other hand, at a mounting axis on a fitment to be fixed to the flap, and there is further provided an additional control arm for moving the flap. During the movement of the actuating arm, the effective lever arm length of the control arm is variable.

Furthermore, the invention concerns an article of furniture comprising an actuating mechanism of the kind to be described, which is provided for moving an upwardly movable flap.

Actuating mechanisms of that kind are used for moving flaps of articles of furniture which are movably mounted between a vertical position, in which a storage compartment of the furniture body is closed, and an upwardly directed open position. When the flap is opened, the flap can perform a considerable lifting-away movement in relation to the face of the furniture carcass, which is perceived by the user as being unpleasant because on the one hand, a relatively large amount of free space has to be provided and, on the other hand, there is also the danger that the user in front of the carcass of the cupboard can suffer injuries to the head due to excessive outward pivotal movement of the flap. As a result, the operator during the opening movement of the flap will intuitively dodge rearwardly out of the way when the flap moves at the level of his head.

EP 0 952 290 A2 and EP 1 785 565 A2 disclose fittings for upwardly moving furniture flaps, comprising a spring-loaded actuating arm and a control mechanism in the form of two hingedly interconnected pivot levers, the effective lever arm length of which is increased in the opening movement of the flap. A disadvantage in this arrangement is the risk that the flap of the article of furniture can easily collide with the head of the user in the course of the opening movement.

SUMMARY OF THE INVENTION

It is therefore an object of the present invention to provide an actuating mechanism of the general kind set forth in the opening part of this specification, with improved kinematics for substantially avoiding the above-indicated disadvantages.

In accordance with the invention in an advantageous configuration, this object is achieved in that the effective lever arm length of the control arm is shortened when the actuating arm is opened.

The basic concept of the present invention therefore involves shortening the effective lever arm length formed by the control arm in the course of the opening movement of the flap. In that case, the effective lever arm length can be in the form of a function of the rotational angle of the actuating arm which supports the movement of the flap in respect of force. In this connection, it is possible to provide, in particular, a non-linear progression. Namely, the effective lever arm length of the control arm changes less in a first opening angle range of the actuating arm, adjoining the closed position, than in a second opening angle range adjoining the first opening angle range and extending towards the completely open position of the actuating arm.

In that way, it is possible for the flap to be moved in a first pivotal range starting from the fully closed position in parallel relationship with itself (that is to say, substantially parallel to the face of the furniture body or carcass) and then to pivot away over the furniture carcass. In this case, the flap in a region immediately in front of the fully open position performs a relatively great pivotal movement due to a corresponding strongly pronounced change in the length of the control arm.

The proposed construction provides, on the one hand, that the lifting-away movement of the flap in relation to the face of the furniture carcass can be kept small. On the other hand, it is also possible for the flap not to reach the maximum room height by a correspondingly great pivotal movement in the region immediately in front of the completely open position so that in its open position the flap can be still easily actuated by the operator.

A further advantage is also that, in the case of a motor-driven flap—particularly during the closing movement—the risk that the lower edge of the flap hits the user on the head is reduced. The control arm is, on the one hand, pivotally connected to a bearing axis associated with the furniture carcass and, on the other hand, pivotally connected to the flap. The invention now provides that the relative spacing between the carcass-side bearing axis of the control arm and the flap-side bearing axis of the control arm is altered, preferably shortened, in the course of the pivotal movement of the actuating arm.

In structural respects, the configuration can be such that the control arm comprises at least two portions movable relative to each other. In that respect, relative mobility is to be interpreted as meaning that all possible mounting options of the at least two portions relative to each other are embraced, which can involve a reduction in the spacing of the carcass-side and the flap-side bearing axis of the control arm during the pivotal movement of the flap.

In a possible embodiment, it can be provided that the at least two portions are connected together by way of a hinge axis. There is provided an additional intermediate lever which is operative between the hinge axis of the at least two portions and a hinge axis on the actuating arm. In that case, the additional intermediate lever takes over the function of providing positive control, by which the two hingedly interconnected lever portions are folded during the opening movement of the actuating arm. In that case, the lever portions—starting from the completely closed position of the actuating arm—are initially only slightly angled, but in a second pivotal range as far as the completely open position of the actuating arm, they are relatively greatly folded, whereby it is possible to implement the desired opening progression for the flap.

In accordance with a further embodiment of the invention, it can be provided that the relative position of the at least two portions relative to each other can be varied by a drive device, preferably an electric drive. In a further embodiment, the electric drive performs adjustment of the relative position of the at least two portions relative to each other by way of a transmission mechanism. In that case, the electric drive for altering the spacing between the carcass-side bearing axis and the flap-side bearing axis of the control arm can be actuated so that in a first rotary angle range of the actuating arm, starting from the completely closed position thereof, the electric drive is either not moved at all or is moved only slightly, while in an opening angle range of the actuating arm, which is right in front of the completely open position of the actuating arm, a more greatly pronounced relative reduction in length of the control arm is effected.

In accordance with a first variant of the invention, the control arm can have a carcass-side bearing axis arranged at or in a main body of the actuating mechanism. Alternatively, the bearing axis of the control arm can also be arranged on a mounting portion separate from the main body of the actuating mechanism, on the article of furniture. In that case, the carcass-side bearing axis of the control arm can be arranged in the uppermost region of the carcass of the article of furniture and preferably in the region of the front face of the carcass of the article of furniture. The carcass-side bearing axis and the flap-side bearing axis of the actuating arm thus form a hinge quadrilateral with the carcass-side bearing axis and the flap-side bearing axis of the control arm. The area formed by the hinge quadrilateral can be increased by the arrangement of the carcass-side mounting axis in the uppermost and foremost region of the carcass of the article of furniture, whereby it is possible to implement advantageous lever ratios for the movement of the flap.

BRIEF DESCRIPTION OF THE DRAWINGS

Further details and advantages of the present invention will be apparent from the specific description hereinafter. In the drawings.

DETAILED DESCRIPTION OF THE INVENTION

Figure 1:
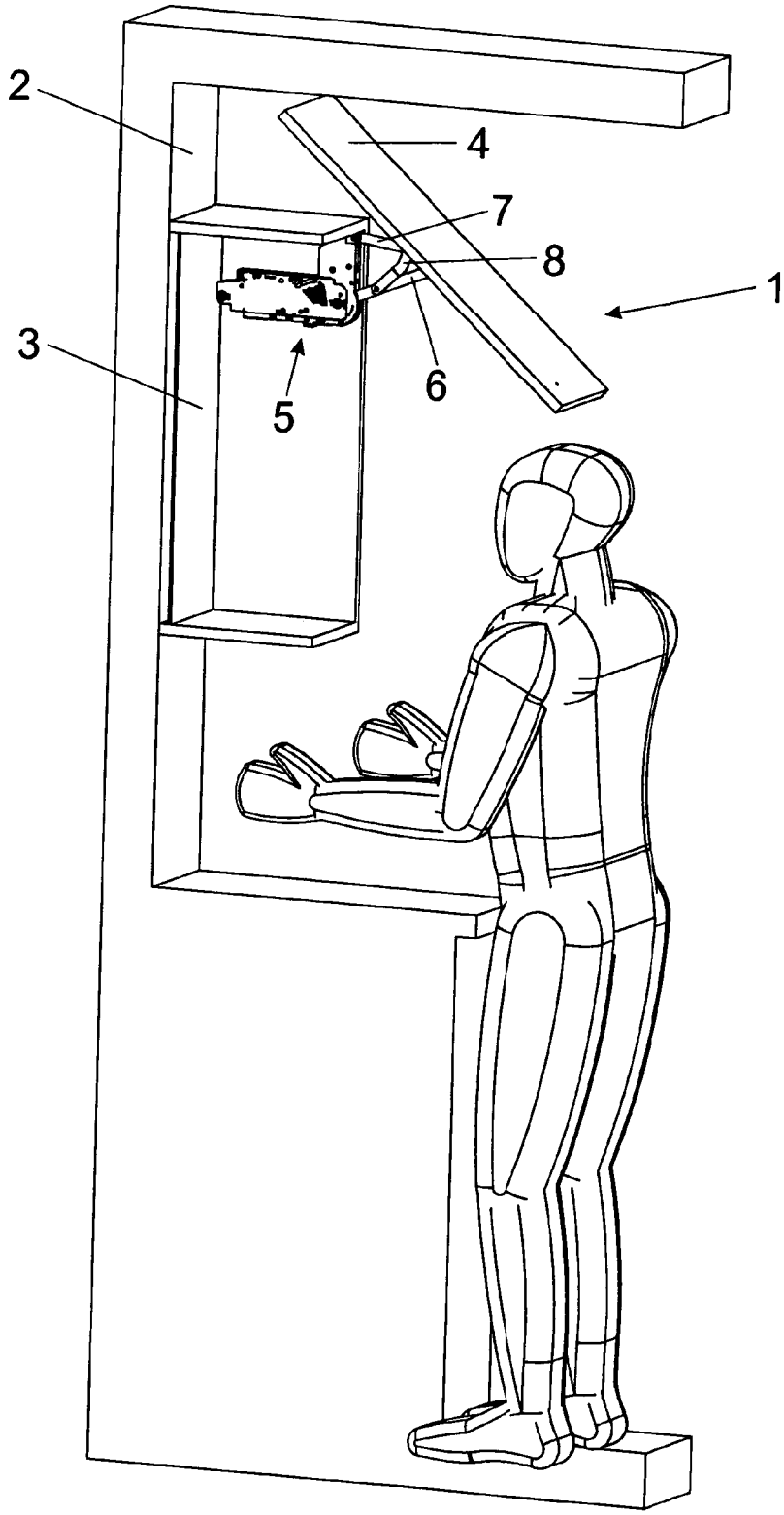
FIG. 1 shows a perspective view of a wall-mounted article of furniture having an actuating mechanism for the movement of an upwardly pivotable flap.

FIG. 1 shows a perspective view of an article of furniture 1 in the form of a cupboard which is fixed to a wall 2 and which in particular is used as an upper cabinet in a kitchen. The article of furniture 1 includes a body or carcass 3 which is to be fixed to the wall 2. To the side wall of the furniture piece 1 there is mounted an actuating mechanism 5 according to the invention for displacement of an upwardly pivotable flap 4. In the closed position, the flap 4 assumes a substantially vertical position and, starting from that vertical position, is movable into an upwardly displaced open position. For reasons of clarity of the drawing, only a part of the flap 4 and the furniture carcass 3 is shown. An actuating mechanism 5 can also be arranged at the inside of the oppositely disposed side wall of the article of furniture 1. The actuating mechanism 5 comprises an actuating arm 6 which can be acted upon by a drive device which is not shown in greater detail here (spring device and/or electric motor). As a result, the actuating arm 6 therefore assists with the movement of the flap 4, in respect of the force involved there. In addition to the actuating arm 6, there is also provided a control arm 7 which influences the motion characteristic of the flap 4 during its travel movement. During the opening progression of the flap 4, conventional structures can involve a considerable lifting-away movement of the flap 4 in relation to the front face of the furniture carcass 3, so that the user runs the risk of suffering injury. The invention now proposes reducing the effective lever arm length of the control arm 7 during the opening progression of the flap 4, and that is implemented by the intermediate lever 8. The intermediate lever 8 is operative between the actuating arm 6 and the control arm 7 so as to provide for positive displacement of the control arm 7, as is to be described in greater detail with reference to following Figures.

Figure 2:
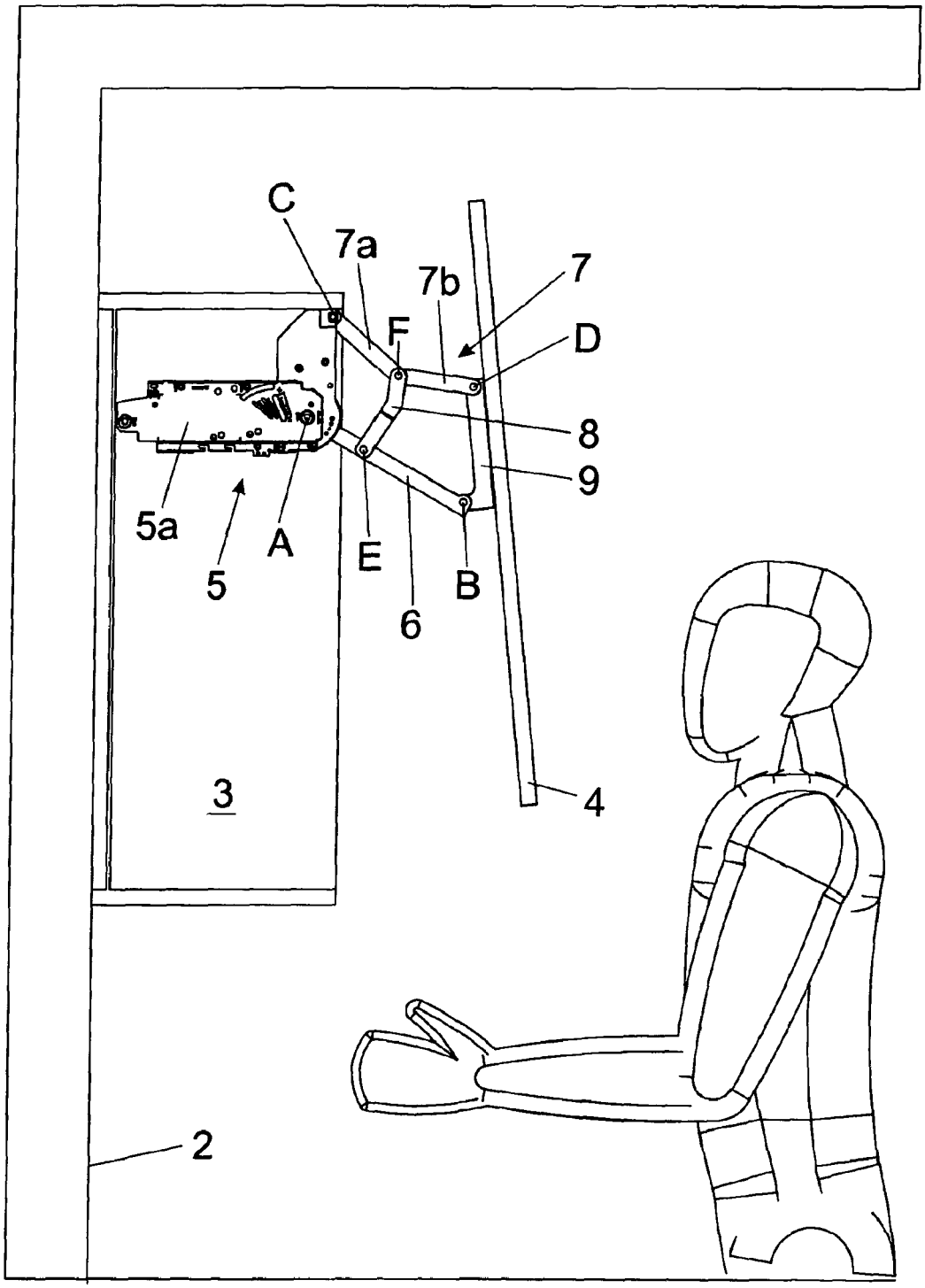
FIG. 2 shows a side view of the arrangement of FIG. 1, FIGS. 3*a*-3*d* show the opening progression of the flap in time sequences.

FIG. 2 shows the arrangement of FIG. 1 in a side view. Mounted to at least one side wall of the furniture carcass 3 is an actuating mechanism 5 which includes a drive device which is not shown in greater detail (spring device and/or electric motor) for actuating the actuating arm 6. The actuating arm 6 is arranged at the carcass side at or in a main body 5*a* at a bearing axis A while the other distal end of the actuating arm 6 is hingedly mounted to the flap-side fitment 9 at a bearing axis B. In addition to the actuating arm 6, there is also provided a control arm 7 which in the illustrated embodiment includes two portions 7*a* and 7*b* which are hingedly connected together at the hinge axis F. The control arm 7 with the two portions 7*a*, 7*b* is therefore mounted at the carcass side at the bearing axis C and at the flap side at the fitment 9 at the bearing axis D. A—preferably cranked—intermediate lever 8 connects the actuating arm 6 at the hinge axis E to the control arm 7 at the hinge axis F. Starting from the fully closed position of the flap 4, the two portions 7*a* and 7*b* of the control arm 7 are only insignificantly folded, whereby substantially parallel guidance for the flap 4 is possible in relation to the front face of the furniture carcass 3. As from a given angle of pivotal movement of the actuating arm 6 (for example, from 70° in relation to the vertical), a more greatly pronounced bending movement of the two portions 7*a* and 7*b* is effected by the intermediate lever 8, whereby the flap 4 performs a correspondingly great pivotal movement and is pivotable rearwardly beyond the furniture carcass 3.

Figure 3A:
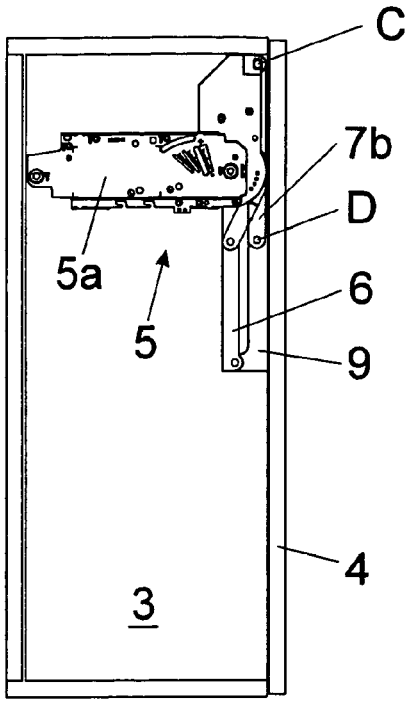

FIGS. 3*a*-3*d* show the opening progression of the flap 4 in time sequences. FIG. 3*a* shows the flap 4 in the completely closed position. The actuating mechanism 5 with its actuating arm 6 for supporting movement of the flap 4 is fixed to a side wall of the furniture carcass 3. Of the control arm 7, it is possible to see the second portion 7*b* which is pivotally connected with respect to the flap-side bearing axis D of the flap-side fitment 9. The reference C denotes the carcass-side bearing axis of the control arm 7, which can be arranged either at the main body 5*a* of the actuating mechanism 5 or also separately therefrom at the furniture carcass 3. The relative spacing S, shown in FIG. 5*b*, between the two bearing axes C and D (i.e., effective lever arm length of the control arm 7) can be reduced in the course of the opening movement of the flap 4, and is of significance.

Figure 3B:
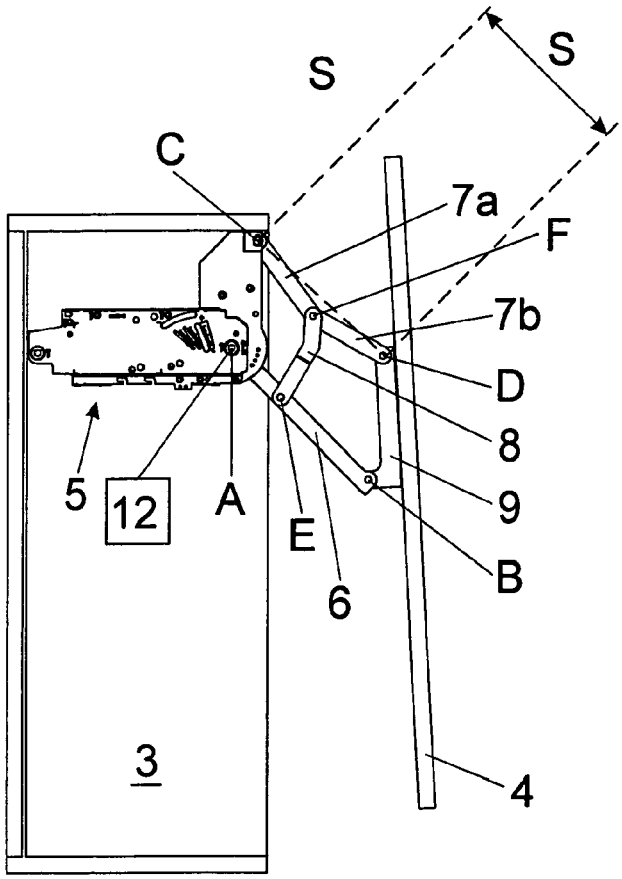

FIG. 3*b* shows the flap 4 in a slightly open position, wherein the flap 4 is movable in a first pivotal range substantially parallel to itself and performs a movement of lifting away from the furniture carcass 3. In that first pivotal range of the flap 4, the intermediate lever 8 arranged at the hinge axis E on the actuating arm 6 causes only an insignificant folding movement of the two portions 7*a*, 7*b* of the control arm 7. Reference S denotes the relative spacing (normal spacing) between the two bearing axes C and D of the control arm 7. In addition, a diagrammatically illustrated electric motor 12 can also operate on the bearing axis A of the actuating arm 6 arranged on the main body 5*a*.

Figure 3C:
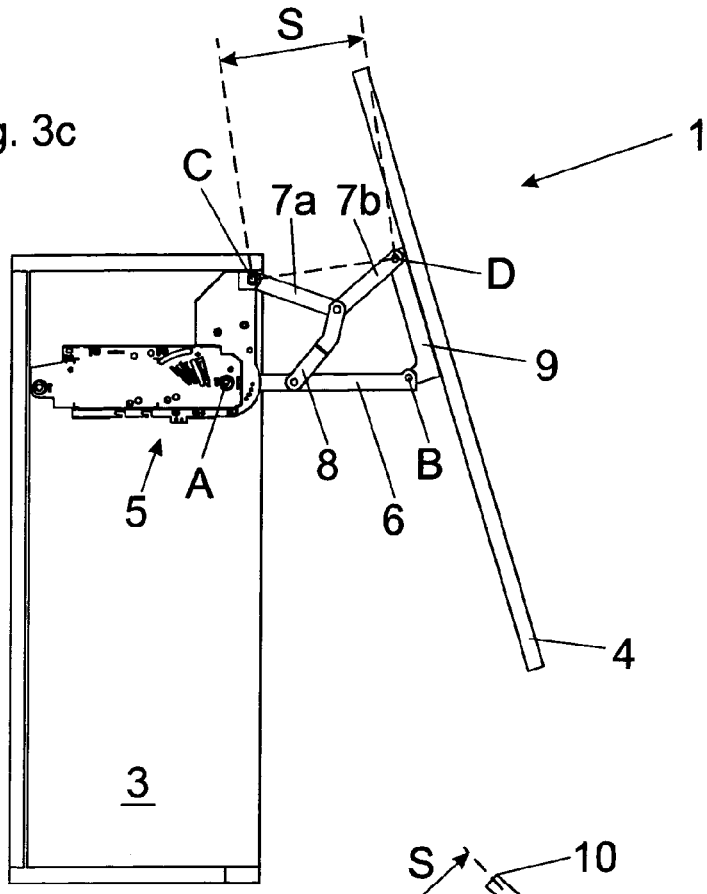

FIG. 3*c* shows a further movement of the flap 4, which is continued from FIG. 3*b*, and in which the two parts 7*a*, 7*b* of the control arm 7 are admittedly bent (i.e., angled relative to each other) somewhat more greatly by the intermediate lever 8. In comparison with FIG. 3*b*, that involves only an immaterial change in the spacing S between the carcass-side bearing axis C and the flap-side bearing axis D of the control arm 7.

Figure 3D:
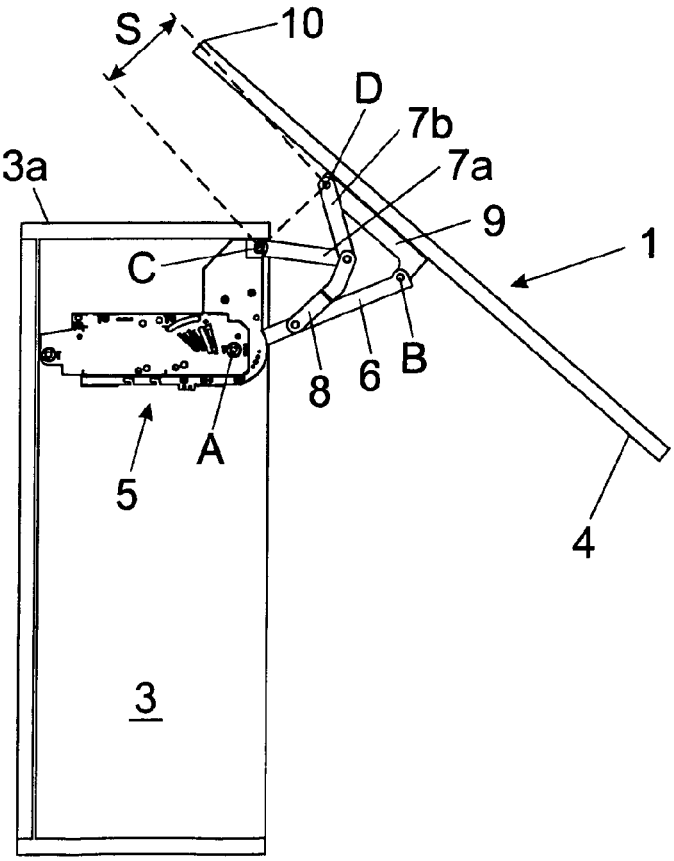

FIG. 3*d* shows an open position of the flap 4, which is continued from FIG. 3*c*. It is possible to see a relatively severe bending motion of the two portions 7*a*, 7*b* of the control arm 7, which is caused by the cranked intermediate lever 8. It is possible to see the spacing S, which is markedly reduced in comparison with FIG. 3*c*, between the carcass-side bearing axis C and the flap-side bearing axis D of the control arm 7. In other words, the effective lever arm length of control arm 7 (i.e., the distance between the carcass-side bearing axis C of control arm 7 and the flap-side bearing axis D of control arm 7) is significantly and continuously reduced as flap 4 is moved from the closed position to the open position. Starting from the position of the flap 4 as shown in FIG. 3*d*, the flap 4 can be moved into the completely open position, wherein the proposed kinematics of the actuating mechanism 5 means that the upper edge 10 of the flap 4 can be moved relatively closely to the cupboard top 3*a* of the carcass 3 of the article of furniture 1.

Figure 4A:
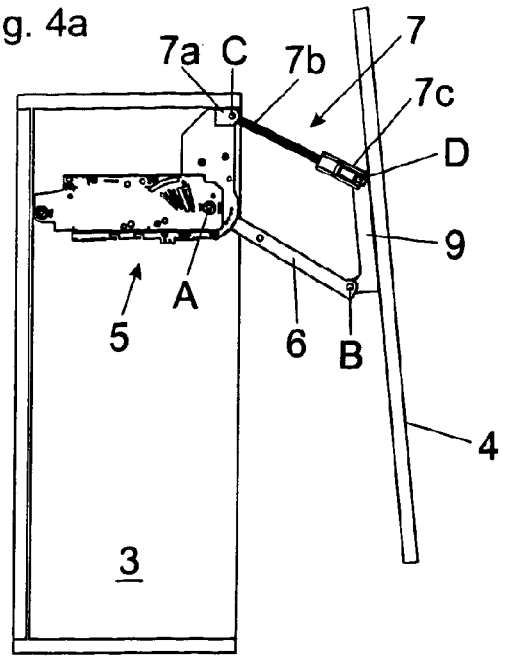
FIGS. 4*a*-4*c* show an alternative embodiment having a control arm which includes a spindle drive.
Figure 4C:
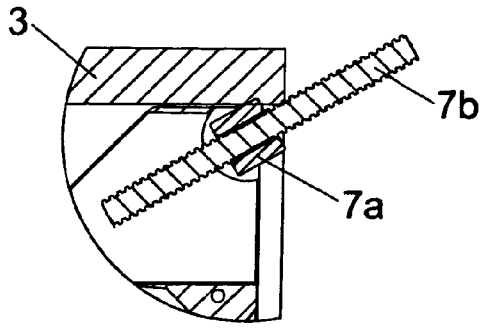
Figure 4B:
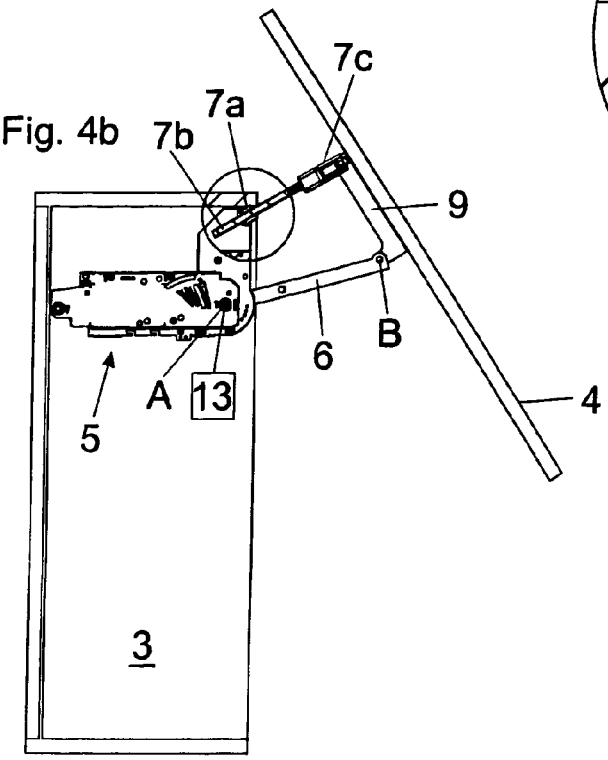

FIGS. 4*a*-4*c* show a side view of an alternative embodiment of the invention. As in the preceding embodiments, the actuating mechanism 5 includes an actuating arm 6 which is pivotally arranged at the carcass side at the bearing axis A and at the flap side at the bearing axis B. The control arm 7 in contrast includes a portion 7*a* which is in the form of a spindle nut and which at the same time forms the bearing axis C of the control arm 7. In addition the control arm 7 comprises a spindle 7*b* movable relative to the portion 7*a* (spindle nut). Moreover, the control arm 7 includes a mounting portion 7*c* which is pivotally fixed at the bearing axis D to the flap-side fitment 9. The mounting portion 7*c* serves to receive an electric drive by which the portion 7*b* (spindle) is rotatable and is thereby movable in a variable-length relationship with respect to the portion 7*a* (spindle nut). In that case, the electric drive arranged at the mounting portion 7*c* can be operated again in dependence on the angular position of the actuating arm 6 so that, starting from the completely closed position of the flap 4, there is only a slight change in length of the control arm 7, while from a predetermined or predeterminable opening angle of the actuating arm 6 towards the fully open position of the flap 4, the effective lever arm length of the control arm 7 is altered more greatly than in the first pivotal range of the flap 4.

FIG. 4*b* shows a control arm 7 which is shortened in comparison to FIG. 4*a*, the control arm 7 having a reduced effective lever arm length, as the portion 7*b* (spindle) projects into the interior of the furniture carcass by virtue of the motor displacement produced. It will be appreciated that it is also possible for the electric drive integrated in the mounting portion 7*c* also to be arranged at the body side. Equally, instead of the illustrated spindle drive, it is also possible to provide a linearly movable rack with a rotatable pinion for adjusting the lever arm length of the control arm 7. Reference 13 denotes a schematically depicted device for detecting the angular position of the actuating arm 6, by which the electric drive for displacement of the two portions 7*a*, 7*b* relative to each other is selectively actuable.

FIG. 4*c* shows a view on an enlarged scale of the region circled in FIG. 4*b*, with a carcass-side spindle nut 7*a* and a spindle 7*b* which projects into the interior of the furniture carcass 3.

Figure 5:
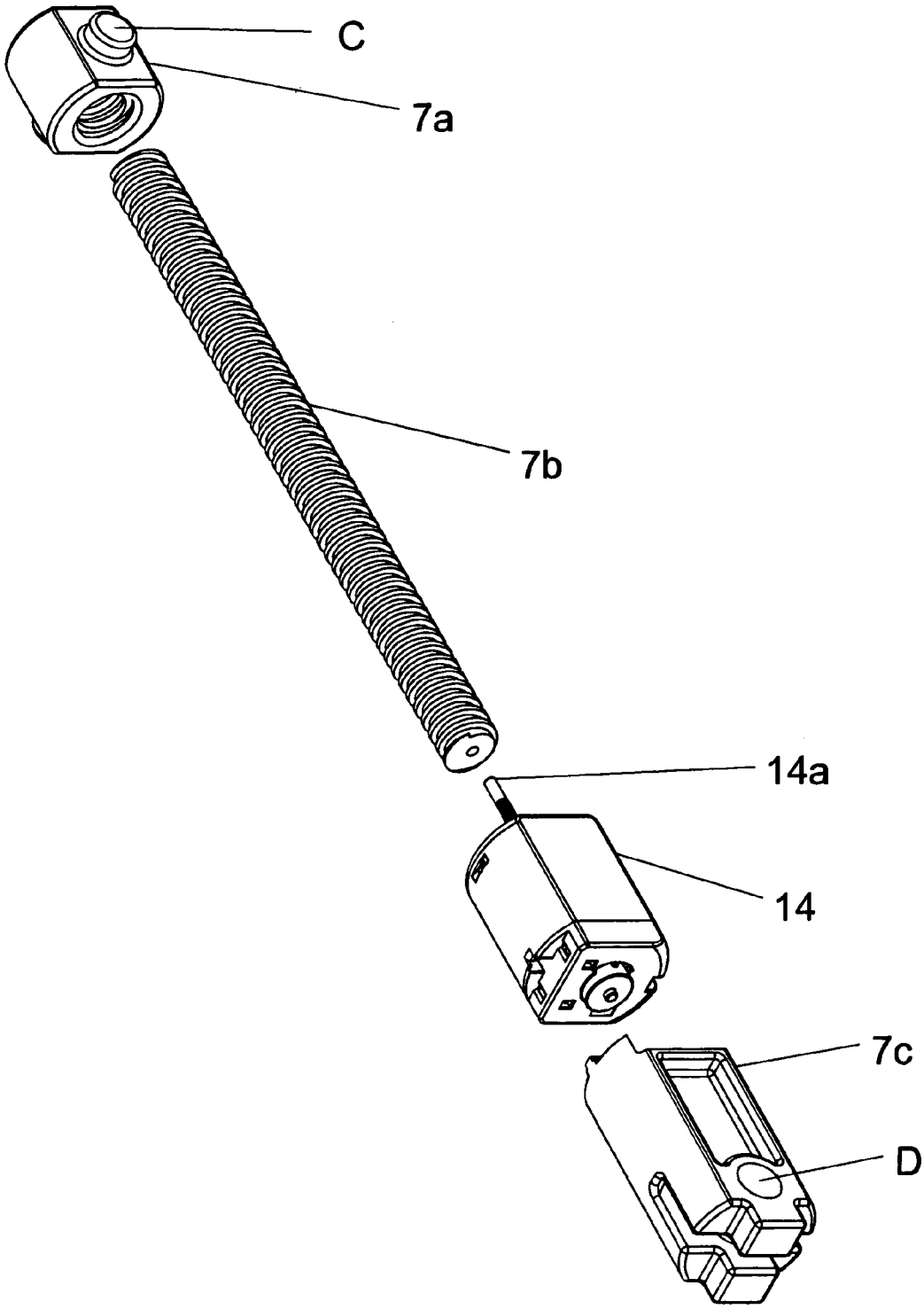
FIG. 5 shows a perspective view of the control arm with a motor-operable spindle drive.

FIG. 5 shows a possible embodiment of a spindle drive for implementing the control arm 7. An electric drive 14 with drive shaft 14*a*, which can be arranged at or in the mounting portion 7*c*, acts directly or by way of a transmission mechanism on the portion 7*b* which is in the form of a spindle. The effective lever arm length of the control arm 7 can be altered, preferably shortened by a rotary movement of the spindle, produced by the electric drive 14.

Figure 6:
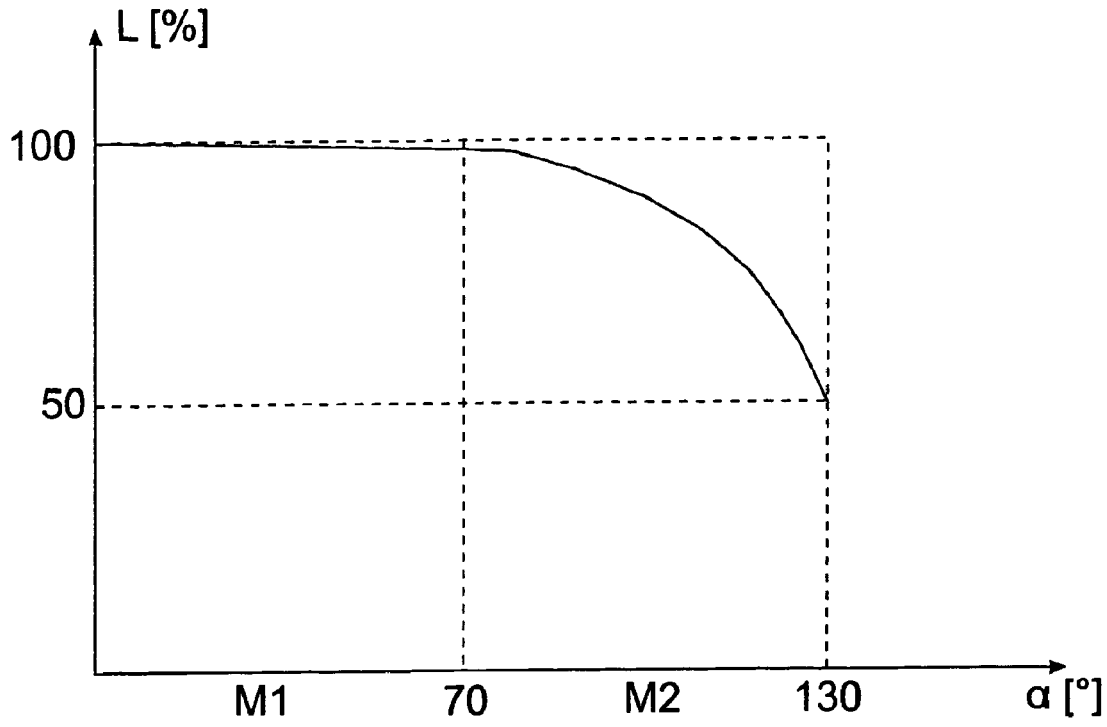
FIG. 6 shows a diagram illustrating the curve configuration of the effective lever arm length of the control arm as a function of the opening angle of the actuating arm.

FIG. 6 shows by way of example the variation in the effective lever arm length of the control arm 7 as a function of the opening angle $\alpha$ of the actuating arm 6. The actuating arm angle $\alpha$ is specified at the abscissa while the effective lever arm length L of the control arm is specified at the ordinate (in %). In a first opening angle range M1 of the actuating arm 6, starting from the completely closed position, the control arm 7 substantially retains its effective lever arm length L, a parallel movement of the flap being made possible. From approximately half the opening angle of the actuating arm $\alpha$ (for example from about 60°) a second pivotal range M2 adjoining the first pivotal range M1 involves a pronounced reduction in the length of the control arm 7, whereby the flap 4 folds greatly beyond the furniture carcass 3. The effective lever arm length L of the control arm 7 can be about 50% of the original effective lever arm length, in the completely open position of the actuating arm 6. It should be noted that in that case, numerous alternative configurations are possible for the person skilled in the art, for implementing the curve configuration.

The invention is not limited to the illustrated embodiments but includes or extends to all variants and technical equivalents which can fall within the scope of the accompanying claims. The positional references adopted in the description such as for example up, down, lateral and so forth are related to the figure being directly described and illustrated and upon a change in position are to be appropriately transferred to the new position. In the illustrated embodiments, for reasons of simplicity and greater ease of understanding, a control arm 7 which is shortened in the course of the movement travel of the flap 4 and by which the flap 4 is pivotable beyond the furniture carcass 3 in the course of the flap opening progress was shown in each case. It will be appreciated that it is also in accordance with the invention for the effective lever arm length L of the control arm 7 to increase upon opening of the flap 4, whereby during its opening progress the flap 4 is also pivotable over a user disposed in front of the furniture carcass 3.

The invention claimed is:

1. An actuating mechanism for moving an upwardly movable flap of an article of furniture, comprising:

a main body to be fixed to a furniture carcass of the article of furniture;

a fitment to be fixed to the flap;

an actuating arm for moving the flap, said actuating arm having a first end mounted to an actuating arm bearing axis of said main body and having a second end mounted to an actuating arm bearing axis of said fitment, said actuating arm having a first hinge axis located between said first end and said second end;

a drive device for driving said actuating arm;

a control arm for moving the flap, said control arm including a first portion and a second portion hingedly connected to each other at a second hinge axis, said first portion being pivotally mounted to a carcass-side bearing axis to be located on the furniture carcass, said second portion being pivotally mounted to a fitment-side bearing axis on said fitment, said control arm being configured such that a distance between said carcass-side bearing axis and said fitment-side bearing axis is shortened during opening of the flap; and an intermediate lever having a first end connected to said first hinge axis and a second end connected to said second hinge axis so as to link said actuating arm to said control arm.

2. The actuating mechanism of claim 1, wherein said control arm is configured such that the distance between said carcass-side bearing axis and said fitment-side bearing axis is continuously shortened during opening of the flap from a fully closed position of the flap.

3. The actuating mechanism of claim 1, wherein a first end of said first portion is pivotally mounted to said carcass-side bearing axis on the furniture carcass, a second end of said first portion is hingedly connected to a first end of said second portion at said second hinge axis, and a second end of said second portion is pivotally mounted to said fitment-side bearing axis on said fitment so that said first portion and said second portion are movable relative to each other.

4. The actuating mechanism of claim 1, wherein said control arm is configured such that the distance between said carcass-side bearing axis and said fitment-side bearing axis shortens less during a first opening angle range than during a second opening angle range, the first opening angle range being between a fully closed position of the flap and a half-open position of the flap, and the second opening angle range being between the half-open position of the flap and a fully-open position of the flap.

5. The actuating mechanism of claim 1, wherein said carcass-side bearing axis is to be located substantially in an uppermost region of the furniture carcass and in a region of a front face of the furniture carcass.

6. The actuating mechanism of claim 5, wherein said intermediate lever comprises a non-straight intermediate lever connected between said second hinge axis of said control arm and a said first hinge axis of said actuating arm.

7. The actuating mechanism of claim 5, wherein said carcass-side bearing axis and said fitment-side bearing axis of said control arm form a hinge quadrilateral with said actuating arm bearing axis of said main body and said actuating arm bearing axis of said fitment.

8. The actuating mechanism of claim 1, wherein said actuating arm has a one-piece construction.

9. The actuating mechanism of claim 1, wherein said control arm is arranged above said actuating arm.

10. An article of furniture comprising:

a furniture carcass;

a movable flap movable relative to said furniture carcass; and an actuating mechanism for moving said flap relative to said furniture carcass, said actuating mechanism including:

a main body fixed to said furniture carcass;

a fitment fixed to said flap;

an actuating arm for moving said flap, said actuating arm having a first end mounted to an actuating arm bearing axis of said main body and having a second end mounted to an actuating arm bearing axis of said fitment, said actuating arm having a first hinge axis located between said first end and said second end;

a drive device for driving said actuating arm;

a control arm for moving said flap, said control arm including a first portion and a second portion hingedly connected to each other at a second hinge axis, said first portion being pivotally mounted to a carcass-side bearing axis on said furniture carcass, said second portion being pivotally mounted to a fitment-side bearing axis on said fitment, said control arm being configured such that a distance between said carcass-side bearing axis and said fitment-side bearing axis is shortened during opening of said flap; and an intermediate lever having a first end connected to said first hinge axis and a second end connected to said second hinge axis so as to link said actuating arm to said control arm.

11. The article of furniture of claim 10, wherein said control arm is configured such that the distance between said carcass-side bearing axis and said fitment-side bearing axis is continuously shortened during opening of said flap from a fully closed position of said flap.

12. The article of furniture of claim 10, wherein a first end of said first portion is pivotally mounted to said carcass-side bearing axis on said furniture carcass, a second end of said first portion is hingedly connected to a first end of said second portion at said second hinge axis, and a second end of said second portion is pivotally mounted to said fitment-side bearing axis on said fitment so that said first portion and said second portion are movable relative to each other.

* * * * *